US008473282B2

(12) United States Patent
Yoshioka

(10) Patent No.: US 8,473,282 B2
(45) Date of Patent: Jun. 25, 2013

(54) SOUND PROCESSING DEVICE AND PROGRAM

(75) Inventor: Yasuo Yoshioka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 917 days.

(21) Appl. No.: 12/358,400

(22) Filed: Jan. 23, 2009

(65) Prior Publication Data

US 2009/0192788 A1 Jul. 30, 2009

(30) Foreign Application Priority Data

Jan. 25, 2008 (JP) ..... 2008-014421
Jan. 25, 2008 (JP) ..... 2008-014422

(51) Int. Cl.
*G10L 11/04* (2006.01)

(52) U.S. Cl.
USPC ..... 704/206; 704/208; 704/212; 704/214

(58) Field of Classification Search
None
See application file for complete search history.

(56) References Cited

U.S. PATENT DOCUMENTS

| | | | | |
|---|---|---|---|---|
| 6,178,316 | B1 * | 1/2001 | Dinnan et al. | 455/296 |
| 7,876,918 | B2 * | 1/2011 | Luo | 381/317 |
| 2002/0191804 | A1 * | 12/2002 | Luo et al. | 381/312 |
| 2003/0115054 | A1 * | 6/2003 | Iso-Sipila | 704/233 |
| 2004/0252047 | A1 * | 12/2004 | Miyake et al. | 342/107 |
| 2005/0177361 | A1 * | 8/2005 | Srinivasan | 704/205 |
| 2009/0226015 | A1 * | 9/2009 | Zeng et al. | 381/316 |

FOREIGN PATENT DOCUMENTS

| | | |
|---|---|---|
| JP | 64-081997 A | 3/1989 |
| JP | 2000-132177 | 5/2000 |

OTHER PUBLICATIONS

Fujita, T. et al. (Mar. 2, 2007). "A Study of Modulation Cepstrum Processing for Robust Speech Recognition," *The Institute of Electronics, Information and Communication Engineers* 106(576):29-33, with English Translation, 23 pages.
Notification of Reasons for Refusal mailed Feb. 14, 2012, for JP Patent Application No. 2008-014421, with English Translation, 11 pages.
Notification of Reasons for Refusal mailed Feb. 14, 2012, for JP Patent Application No. 2008-014422, with English Translation, 12 pages.
Takahashi, W. et al. (Sep. 20, 2007). "A Study on Noise Robust Voice Activity Detection Using RSF," *The Institute of Electronics, Information and Communication Engineers* 107(238):59-64, with English Translation, 23 pages.

(Continued)

*Primary Examiner* — Leonard Saint Cyr
(74) *Attorney, Agent, or Firm* — Morrison & Foerster LLP

(57) ABSTRACT

In a sound processing device, a modulation spectrum specifier specifies a modulation spectrum of an input sound for each of a plurality of unit intervals. An index calculator calculates an index value corresponding to a magnitude of components of modulation frequencies belonging to a predetermined range of the modulation spectrum. A determinator determines whether the input sound of each of the unit intervals is a vocal sound or a non-vocal sound based on the index value. The modulation spectrum specifier analyzes the input sound to obtain a cepstrum or a logarithmic spectrum of the input sound for each of a sequence of frames defined within the unit interval, then specifies a temporal trajectory of a specific component in the cepstrum or the logarithmic spectrum along the sequence of the frames for the unit interval, and performs a Fourier transform on the temporal trajectory throughout the unit interval to thereby specify the modulation spectrum of the unit interval as the result of the Fourier transform of the temporal trajectory.

14 Claims, 10 Drawing Sheets

OTHER PUBLICATIONS

Wada, N. et al. (Nov. 17, 2005). "Noise-Robust Speech Recognition Using Weighted Modulation Spectrum," *The Institute of Electronics, Information and Communication Engineers* 105(426):25-30, with English Translation, 27 pages.

Nakayaka, M. et al. (Sep. 17, 2003). "Adaptive Beamformer with Vowel/Consonant Spectrum for Noisy Speech Recognition," *Acoustic Society of Japan*, Fall Meeting 2003, pp. 507-508, with English Translation, nine pages.

Obuchi, Y. et al. (Sep. 12, 2007). "Development of Audio Database for Speech/Non-Speech Discrimination in Home Environment," *Acoustic Society of Japan*, Fall Meeting 2007, pp. 269-270, with English Translation, eight pages.

* cited by examiner

SOUND PROCESSING DEVICE AND PROGRAM

BACKGROUND OF THE INVENTION

1. Technical Field of the Invention

The present invention relates to a technology for discriminating between a sound uttered by a human being (hereinafter referred to as a "vocal sound") and a sound other than the vocal sound (hereinafter referred to as a "non-vocal sound").

2. Description of the Related Art

A technology for discriminating between a vocal sound interval and a non-vocal sound interval in a sound such as a sound received by a sound receiving device (hereinafter referred to as an "input sound") has been suggested. For example, Japanese Patent Application Publication No. 2000-132177 describes a technology for determining presence or absence of a vocal sound based on the magnitude of frequency components belonging to a predetermined range of frequencies of the input sound.

However, noise has a variety of frequency characteristics and may occur within a range of frequencies used to determine presence or absence of a vocal sound. Thus, it is difficult to determine presence or absence of a vocal sound with sufficiently high accuracy based on the technology of Japanese Patent Application Publication No. 2000-132177.

SUMMARY OF THE INVENTION

The invention has been made in view of these circumstances, and it is an object of the invention to accurately determine whether or not an input sound is a vocal sound or a non-vocal sound.

In accordance with a first aspect of the invention to overcome the above problem, there is provided a sound processing device including a modulation spectrum specifier that specifies a modulation spectrum of an input sound for each of a plurality of unit intervals, a first index calculator (for example, an index calculator 34 of FIG. 2) that calculates a first index value corresponding to a magnitude of components of modulation frequencies belonging to a predetermined range in the modulation spectrum, and a determinator that determines whether the input sound of each of the unit intervals is a vocal sound or a non-vocal sound based on the first index value. In this aspect, since whether the input sound of each unit interval is a vocal sound or a non-vocal sound is determined based on the magnitude of components of modulation frequencies belonging to the predetermined range in the modulation spectrum, it is possible to more accurately determine whether the input sound is a vocal sound or a non-vocal sound than the technology of Japanese Patent Application Publication No. 2000-132177 which uses the frequency spectrum of the input sound.

The range used to calculate the first index value in the modulation spectrum is empirically or statistically set such that the magnitude of the modulation spectrum within the range is increased when the input sound is one of a vocal sound and a non-vocal sound and the magnitude of the modulation spectrum outside the range is increased when the input sound is the other of the vocal sound and the non-vocal sound. Now, let us focus attention on the tendency that the magnitude in a range of modulation frequencies below a predetermined boundary value (for example, 10 Hz) in the modulation spectrum is increased when the input sound is a vocal sound and the magnitude in a range of modulation frequencies above the boundary value in the modulation spectrum is increased when the input sound is a non-vocal sound. In the case where the first index value is defined such that it increases as the magnitude of components of modulation frequencies below the boundary value in the modulation spectrum increases, the determinator, for example, determines that the input sound is a vocal sound when the first index value is higher than a threshold and determines that the input sound is a non-vocal sound when the first index value is lower than the threshold. In the case where the first index value is defined such that it decreases as the magnitude of components of modulation frequencies below the boundary value in the modulation spectrum increases, the determinator, for example, determines that the input sound is a vocal sound when the first index value is lower than a threshold and determines that the input sound is a non-vocal sound when the first index value is higher than the threshold. On the other hand, in the case where the first index value is defined such that it increases as the magnitude of components of modulation frequencies above the boundary value in the modulation spectrum increases, the determinator, for example, determines that the input sound is a non-vocal sound when the first index value is higher than a threshold and determines that the input sound is a vocal sound when the first index value is lower than the threshold. In the case where the first index value is defined such that it decreases as the magnitude of components of modulation frequencies above the boundary value in the modulation spectrum increases, the determinator, for example, determines that the input sound is a vocal sound when the first index value is higher than a threshold and determines that the input sound is a non-vocal sound when the first index value is lower than the threshold. All the embodiments described above are included in the concept of the process of determining whether the input sound is a vocal sound or a non-vocal sound based on the first index value.

In a preferred embodiment of the invention, the first index calculator calculates the first index value based on a ratio between the magnitude of the components of the modulation frequencies belonging to the predetermined range of the modulation spectrum and a magnitude of components of modulation frequencies belonging to a range including the predetermined range (i.e., a range including the predetermined range and being wider than the predetermined range). In this embodiment, not only the magnitude of components in the predetermined range of the modulation spectrum but also the magnitude of components in a range including the predetermined range (for example, an entire range of modulation frequencies) are used to calculate the first index value. Accordingly, for example, even when the magnitude of a wide range in the modulation spectrum is affected by noise of the input sound, it is possible to accurately determine whether the input sound is a vocal sound or a non-vocal sound, compared to the configuration in which the first index value is calculated based only on the magnitude of the components of the predetermined range.

In a preferred embodiment, the sound processing device further includes a magnitude specifier that specifies a maximum value of a magnitude of the modulation spectrum and the determinator determines whether the input sound is a vocal sound or a non-vocal sound based on the first index value and the maximum value of the magnitude of the modulation spectrum. For example, when it is assumed that a maximum value of a magnitude of a modulation spectrum of a non-vocal sound tends to be lower than a maximum value of a magnitude of a modulation spectrum of a vocal sound, the determinator determines whether the input sound is a vocal sound or a non-vocal sound, such that the possibility that an input sound in the unit interval is determined to be a vocal sound increases as the maximum value of the magnitude of the modulation spectrum increases (or such that the possibility that an input sound in the unit interval is determined to be a non-vocal sound increases as the maximum value of the magnitude decreases). More specifically, even when it may be determined that the input sound is a vocal sound from the first index value, the determinator determines that the input sound is a non-vocal sound if the maximum value of the magnitude of the modulation spectrum is lower than a threshold. In this embodiment, since not only the first index value but also the maximum value of the magnitude of the modulation spectrum are used to determine whether the input sound is a vocal sound or a non-vocal sound, it is possible to accurately determine whether it is a vocal sound or a non-vocal sound even if a range of modulation frequencies with a high magnitude in a modulation spectrum of a non-vocal sound approximates a range of modulation frequencies with a high magnitude in a modulation spectrum of a vocal sound.

In a preferred embodiment, the modulation spectrum specifier includes a component extractor that specifies a temporal trajectory of a specific component in a cepstrum or a logarithmic spectrum of the input sound, a frequency analyzer that performs a Fourier transform on the temporal trajectory for each of a plurality of intervals into which the unit interval is divided, and an averager that averages results of the Fourier transform of the plurality of the divided intervals to specify a modulation spectrum of the unit interval. In this embodiment, since Fourier transform of a temporal trajectory of a logarithmic spectrum or cepstrum is performed on each of a plurality of intervals into which the unit interval is divided, the number of points of Fourier transform is reduced compared to the case where Fourier transform is collectively performed on the temporal trajectory over the entire range of the unit interval. Accordingly, this embodiment has an advantage in that load caused by processes performed by the modulation spectrum specifier or storage capacity required for the processes is reduced.

In accordance with a second aspect of the invention, there is provided a sound processing device includes a modulation spectrum specifier that specifies a modulation spectrum of an input sound for each of a plurality of unit intervals, a first index calculator that calculates a first index value corresponding to a magnitude of components of modulation frequencies belonging to a predetermined range of the modulation spectrum, a storage that stores an acoustic model generated from a vocal sound of a vowel, a second index value calculator that calculates a second index value indicating whether or not the input sound is similar to the acoustic model for each unit interval, and a determinator that determines whether the input sound of each unit interval is a vocal sound or a non-vocal sound based on the first index value and the second index value of the unit interval. In this embodiment, since whether the input sound of each unit interval is a vocal sound or a non-vocal sound is determined based on both the magnitude of components of modulation frequencies belonging to the predetermined range of the modulation spectrum and whether or not the input sound is similar to the acoustic model of the vocal sound of the vowel, it is possible to more accurately determine whether the input sound is a vocal sound or a non-vocal sound than the technology of Japanese Patent Application Publication No. 2000-132177 which uses the frequency spectrum of the input sound.

In accordance with the second aspect of the invention, the storage stores an acoustic model generated from a vocal sound of a vowel, the second index value calculator (for example, an index calculator 54 of FIG. 9) calculates a second index value indicating whether or not an input sound is similar to the acoustic model for each unit interval, and the determinator determines whether an input sound of each unit interval is a vocal sound or a non-vocal sound based on the second index value of the unit interval. In this aspect, since whether an input sound of each unit interval is a vocal sound or a non-vocal sound is determined based on whether or not the input sound is similar to an acoustic model of a vocal sound of a vowel, it is possible to more accurately identify a vocal sound and a non-vocal sound than the technology of Japanese Patent Application Publication No. 2000-132177 which uses the frequency spectrum of the input sound.

In the second aspect, when it is assumed that the degree of similarity between the vocal sound and the acoustic model tends to be higher than the degree of similarity between the non-vocal sound and the acoustic model, the determinator determines that the input sound is a vocal sound if the second index value is at a side of similarity with respect to a threshold and determines that the input sound is a non-vocal sound if the second index value is at the side of dissimilarity of the threshold. For example, in an embodiment where the second index value is defined such that it increases as the similarity between the input sound and the acoustic model increases, the determinator determines that the input sound is a vocal sound if the second index value is higher than the threshold. In addition, in an embodiment where the second index value is defined such that it decreases as the similarity between the input sound and the acoustic model increases, the determinator determines that the input sound is a vocal sound if the second index value is lower than the threshold.

In a detailed example of the sound processing device according to the second aspect, the storage stores one acoustic model generated from vocal sounds of a plurality of types of vowels. Since one acoustic model integrally generated from vocal sounds of a plurality of types of vowels is used, this aspect has an advantage in that the capacity required for the storage is reduced compared to the configuration in which an individual acoustic model is prepared for each type of vowel.

According to a detailed example of the second aspect, the sound processing device includes, for example, a third index value calculator (for example, the index calculator 62 of FIG. 10) that calculates a weighted sum of the first index value and the second index value as a third index value, and the determinator determines whether the input sound of each unit interval is a vocal sound or a non-vocal sound based on the third index value of the unit interval. In this aspect, a weight value used for calculating the weighted sum of the first index value and the second index value is set appropriately, so that it is possible to set whether priority is given to the first index value or the second index value for determining whether the input sound is a vocal sound or a non-vocal sound.

The sound processing device which includes the third index value calculator may further include a weight sum setter that variably sets a weight that the third index value calculator uses to calculate the third index value according to an SN ratio of the input sound. For example, when it is assumed that the first index value tends to be easily affected by noise of the input sound compared to the second index value, the weight setter increases the weight of the second index value relative to the weight of the first index value (i.e., gives priority to the second index value). According to this aspect, it is possible to determine whether the input sound is a vocal sound or a non-vocal sound regardless of noise of the input sound.

According to a detailed example of each of the first and second aspects, the sound processing device includes a voiced sound index calculator (for example, an index calculator 74 of FIG. 10) that calculates a voiced sound index value according to the proportion of voiced sound intervals among a plurality of intervals into which the unit interval is divided, and the determinator determines whether the input sound is a vocal sound or a non-vocal sound based on the voiced sound index value. For example, when it is assumed that the temporal proportion of a voiced sound among a vocal sound tends to be high compared to a non-vocal sound, the determinator determines whether the input sound is a vocal sound or a non-vocal sound, such that the possibility that the input sound of the unit interval is determined to be a vocal sound increases as the proportion of the voiced sound increases (i.e., such that the possibility that the input sound of the unit interval is determined to be a non-vocal sound increases as the proportion of the voiced sound decreases). More specifically, even when it may be determined from the index value calculated by the index calculator (specifically, at least one of the first to third index values) that the index value is determined to be a vocal sound, the determinator determines that the input sound is a non-vocal sound if the proportion of the voiced sound intervals is low. In this embodiment, since not only the index value calculated from the acoustic model or the modulation spectrum but also the voiced sound index value are used to determine whether the input sound is a vocal sound or non-vocal sound, it is possible to accurately discriminate between the vocal sound and the non-vocal sound even when a range of modulation frequencies with a high magnitude in a modulation spectrum of a non-vocal sound is close to a range of modulation frequencies with a high magnitude in a modulation spectrum of a vocal sound in the first or second aspect or when the similarity between the vocal sound and the acoustic model of the vowel is comparable to the similarity between the non-vocal sound and the acoustic model of the vowel in the second aspect.

According to a detailed example of each of the first and second aspects, the sound processing device includes a threshold setter that variably sets a threshold according to the SN ratio of the input sound, and the determinator determines whether the input sound is a vocal sound or non-vocal sound according to whether or not an index value (one of the first index value, the second index value, the third index value, a voiced sound index value, the maximum value of the magnitude of the modulation spectrum) calculated from the input sound is higher than a threshold. In this embodiment, since the threshold, which is to be contrasted with the index value, is variably controlled according to the SN ratio of the input sound, it is possible to maintain the accuracy of determination as to whether the input sound is a vocal sound or non-vocal sound at a high level, without influence of the magnitude of the SN ratio.

According to a detailed example of each of the first and second aspects, the sound processing device includes a sound processor that mutes only input sounds $V_{IN}$ of unit intervals in the middle of a set of three or more consecutive unit intervals when the determinator has determined that the three or more consecutive unit intervals are all a non-vocal sound. In this embodiment, it is possible for the listener to clearly perceive only the vocal sound among the input sound since each unit interval that has been determined to be a non-vocal sound is muted. In addition, the possibility that the start portion (specifically, the last of the three or more unit intervals) and the end portion (specifically, the first of the three or more unit intervals) of a vocal sound are muted through processes performed by the sound processor is reduced since only the unit intervals in the middle of the set of three or more unit intervals that have been determined to be a non-vocal sound (i.e., only the at least one unit interval other than the first and last unit intervals among the three or more unit intervals) are muted.

The sound processing device according to any of the above aspects may be implemented by hardware (electronic circuitry) such as a Digital Signal Processor (DSP) dedicated to processing of the input sound, and may also be implemented through cooperation between a general-purpose arithmetic processing unit such as a Central Processing Unit (CPU) and a program. A program according to the first aspect of the invention causes a computer to perform a modulation spectrum specification process to specify a modulation spectrum of an input sound for each of a plurality of unit intervals, a first index calculation process to calculate a first index value corresponding to a magnitude of components of modulation frequencies belonging to a predetermined range in the modulation spectrum, and a determination process to determine whether the input sound of each of the unit intervals is a vocal sound or a non-vocal sound based on the first index value. A program according to the second aspect of the invention causes a computer to perform a modulation spectrum specification process to specify a modulation spectrum of an input sound for each of a plurality of unit intervals, a first index calculation process to calculate a first index value corresponding to a magnitude of components of modulation frequencies belonging to a predetermined range in the modulation spectrum, a second index calculation process to calculate a second index value indicating whether or not the input sound is similar to an acoustic model generated from a vocal sound of a vowel for each unit interval, and a determination process to determine whether the input sound of each of the unit intervals is a vocal sound or a non-vocal sound based on the first and second index values of the unit interval. The program according to the invention achieves the same operations and advantages as those of the sound processing device according to the invention. The program of the invention may be provided to a user through a machine readable medium storing the program and then be installed on a computer and may also be provided from a server to a user through distribution over a communication network and then installed on a computer.

DETAILED DESCRIPTION OF THE INVENTION

<A: First Embodiment>

Figure 1:
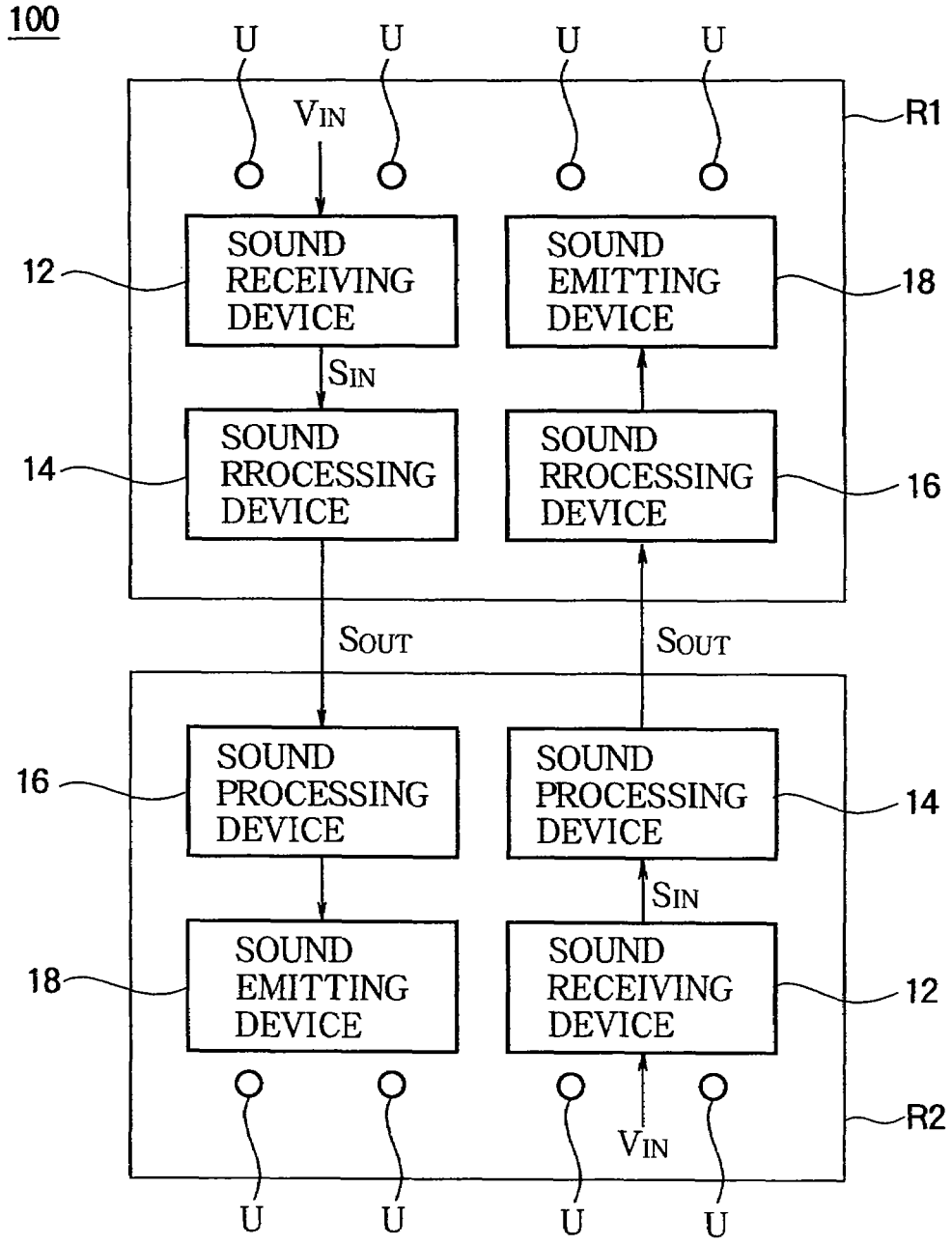
FIG. 1 is a block diagram of a remote conference system according to a first embodiment of the invention.

FIG. 1 is a block diagram of a remote conference system according to a first embodiment of the invention. The remote conference system 100 is a system in which users U (specifically, participants of a conference) in separate spaces R1 and R2 communicate voices with each other. A sound receiving device 12, a sound processing device 14, a sound processing device 16, and a sound emitting device 18 are provided in each of the spaces R (i.e., R1 and R2).

The sound receiving device 12 is a device (specifically, a microphone) for generating an audio signal $S_{IN}$ representing a waveform of an input sound $V_{IN}$ that is present in the space R. The sound processing device 14 of each of the spaces R1 and R2 generates an output signal $S_{OUT}$ from the audio signal $S_{IN}$ and transmits the output signal $S_{OUT}$ to the sound processing device 16 of the other of the spaces R1 and R2. The sound processing device 16 amplifies and outputs the output signal $S_{OUT}$ to the sound emitting device 18. The sound emitting device 18 is a device (specifically, a speaker) that emits a sound wave according to the amplified output signal $S_{OUT}$ provided from the sound processing device 16. According to the configuration described above, a voice generated by each user U in the space R1 is output from the sound emitting device 18 of the space R2 and a voice generated by each user U in the space R2 is output from the sound emitting device 18 of the space R1.

Figure 2:
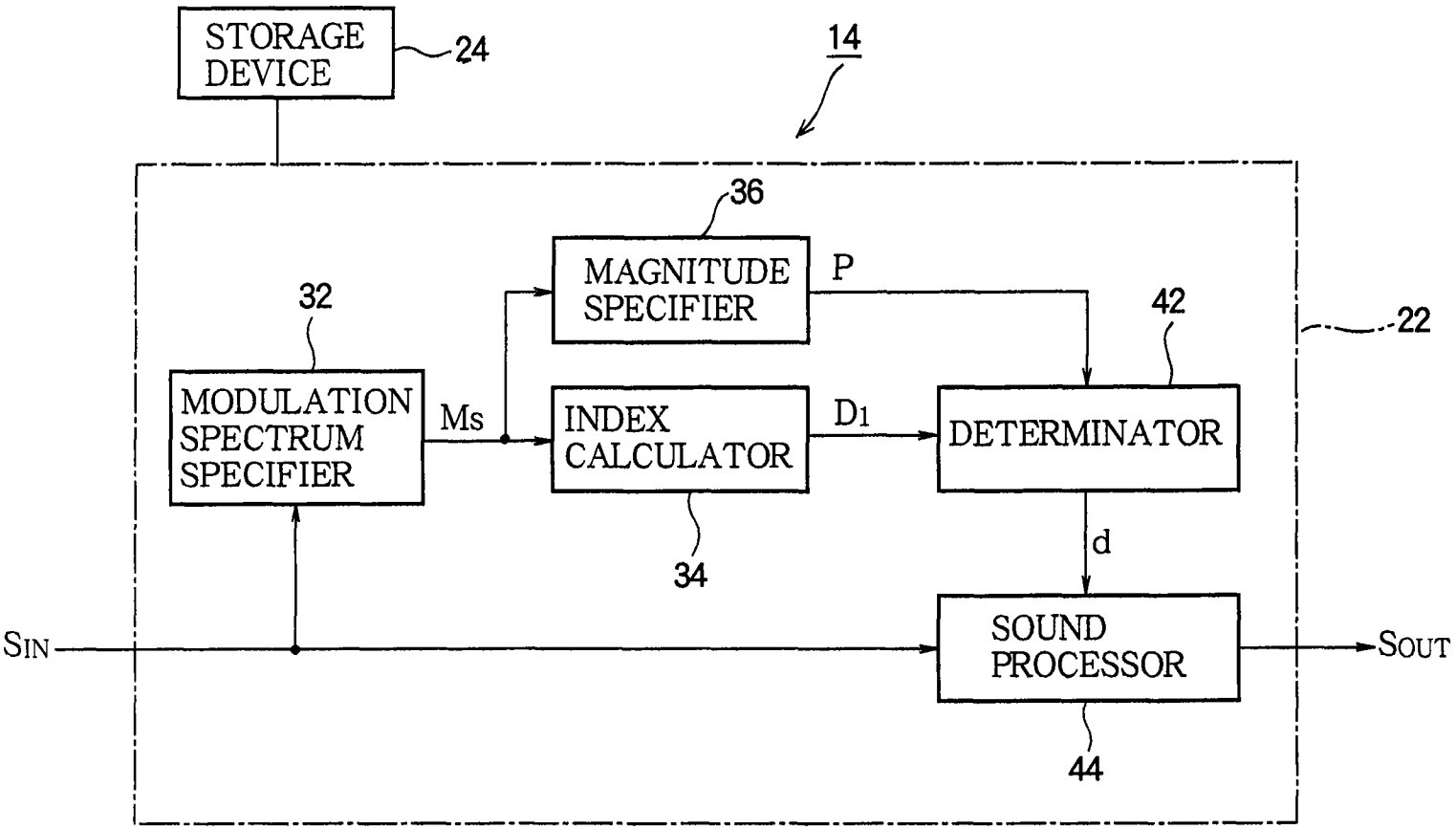
FIG. 2 is a block diagram of a sound processing device in FIG. 1.

FIG. 2 is a block diagram illustrating a configuration of the sound processing device 14 provided in each of the spaces R1 and R2. As shown in FIG. 2, the sound processing device 14 includes a control device 22 and a storage device 24. The control device 22 is an arithmetic processing unit that functions as each component of FIG. 2 by executing a program. Each component of FIG. 2 may also be implemented by an electronic circuit such as DSP. The storage device 24 stores the program executed by the control device 22 and a variety of data used by the control device 22. A known storage medium such as a semiconductor storage device or a magnetic storage device is optionally used as the storage device 24.

The control device 22 implements a function to determine whether the input sound $V_{IN}$ is a vocal sound or a non-vocal sound for each of a plurality of intervals (which will be referred to as "unit intervals") into which the audio signal $S_{IN}$ (i.e., the input sound $V_{IN}$) provided from the sound receiving device 12 is divided in time and a function to generate an output signal $S_{OUT}$ by performing a process corresponding to the determination on the audio signal $S_{IN}$. The vocal sound is a sound uttered by a human being. The non-vocal sound is a sound other than the vocal sound. Examples of the non-vocal sound include an environmental sound (noise) such as a sound produced by operation of an air conditioner or a ringtone of a mobile phone or a sound produced by opening or closing a door of the space R.

The modulation spectrum specifier 32 of FIG. 2 specifies a modulation spectrum MS of the audio signal $S_{IN}$ (input sound $V_{IN}$). The modulation spectrum MS is obtained by performing a Fourier transform on a temporal change of components belonging to a specific frequency band in a logarithmic (frequency) spectrum of the audio signal $S_{IN}$. In the following description, the temporal change of the components belonging to the specific frequency band is referred to as a "temporal trajectory".

Figure 3:
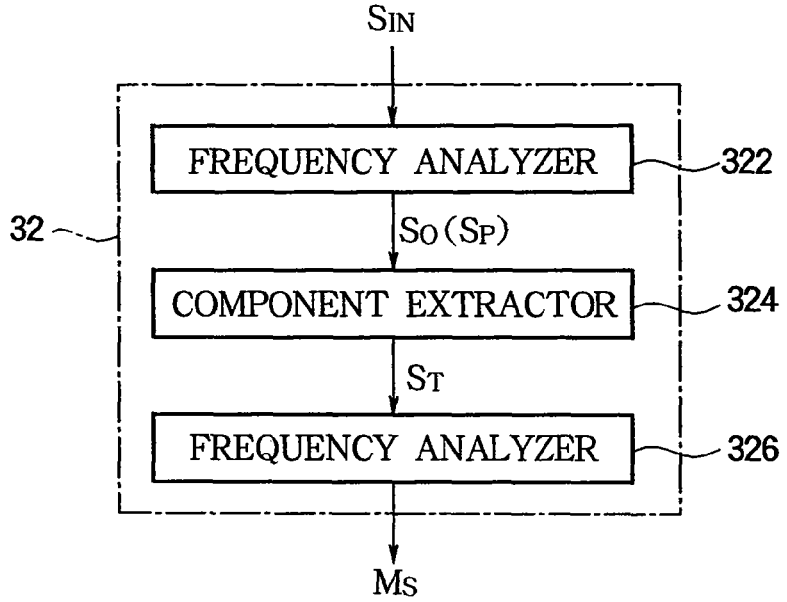
FIG. 3 is a block diagram of a modulation spectrum specifier in FIG. 2.
Figure 4A:
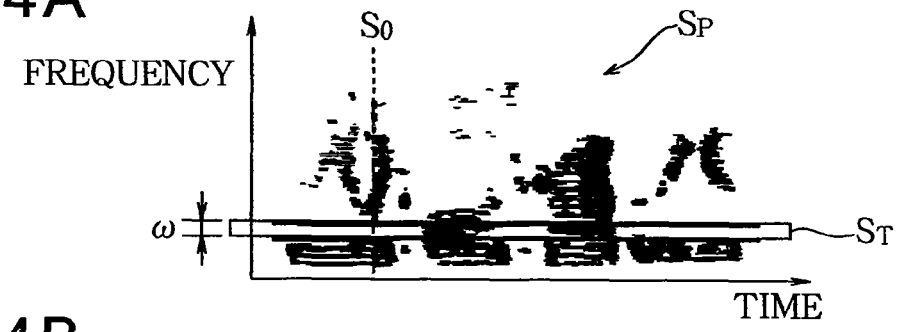
FIGS. 4A to 4C are conceptual diagrams illustrating processes performed by the modulation spectrum specifier in FIG. 2.
Figure 4B:
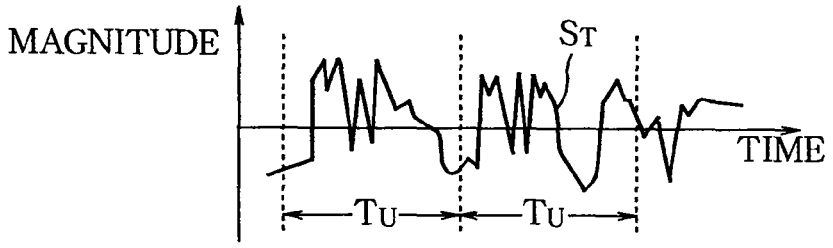
Figure 4C:
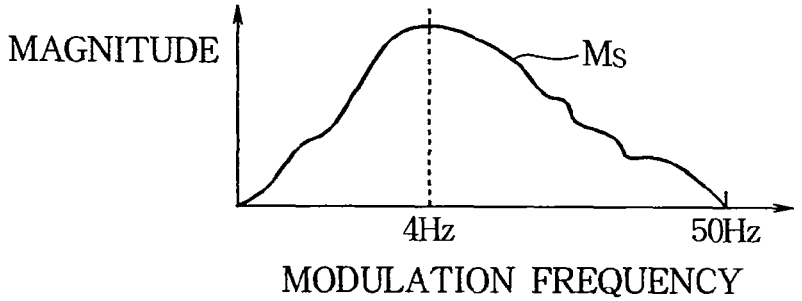

FIG. 3 is a block diagram illustrating a functional configuration of the modulation spectrum specifier 32. FIGS. 4A to 4C are conceptual diagrams illustrating processes performed by the modulation spectrum specifier 32. As shown in FIG. 3, the modulation spectrum specifier 32 includes a frequency analyzer 322, a component extractor 324, and a frequency analyzer 326. The frequency analyzer 322 performs frequency analysis including Fourier transform (for example, Fast Fourier transform) on an audio signal $S_{IN}$ to calculate a logarithmic spectrum $S_0$ of each of a plurality of frames into which the audio signal $S_{IN}$ is divided in time as shown in FIG. 4A. Accordingly, the frequency analyzer 322 generates a spectrogram SP including respective logarithmic spectra $S_0$ of frames which are arranged along the time axis. Adjacent frames may be set so as to partially overlap or may be set so as not to overlap.

The component extractor 324 of FIG. 3 extracts a temporal trajectory $S_T$ of the magnitude (or energy) of components belonging to a specific frequency band ω in the spectrogram SP as shown in FIGS. 4A and 4B. More specifically, the component extractor 324 generates the temporal trajectory $S_T$ by calculating the magnitude of components belonging to the frequency band ω in each of the logarithmic spectra of the plurality of frames and arranging the magnitudes of the logarithmic spectra of the plurality of frames in chronological order. The frequency band ω is empirically or statistically preselected such that the frequency characteristics (specifically, modulation spectrum MS) of the temporal trajectory $S_T$ when the input sound is a vocal sound are significantly different from those of the temporal trajectory $S_T$ when the input sound is a non-vocal sound. For example, the frequency band ω is determined to range from 10 Hz (preferably, 50 Hz) to 800 Hz. The component extractor 324 may also be designed to extract, as a temporal trajectory $S_T$, a temporal change of the magnitude of one frequency component in each logarithmic spectrum $S_0$. The magnitude represents an intensity or strength or amplitude of the frequency component.

As shown in FIG. 4B and 4C, the frequency analyzer 326 of FIG. 3 performs Fourier transform (for example, FFT) on the temporal trajectory $S_T$ to calculate a modulation spectrum MS of each of a plurality of unit intervals $T_U$ into which the temporal trajectory $S_T$ is divided in time. Each unit interval $T_U$ is a period of a specific length of time (for example, about 1 second) including a plurality of frames. Although the unit intervals $T_U$ which do not overlap each other are illustrated in this embodiment for ease of explanation, adjacent unit intervals $T_U$ may also partially overlap.

Figure 5:
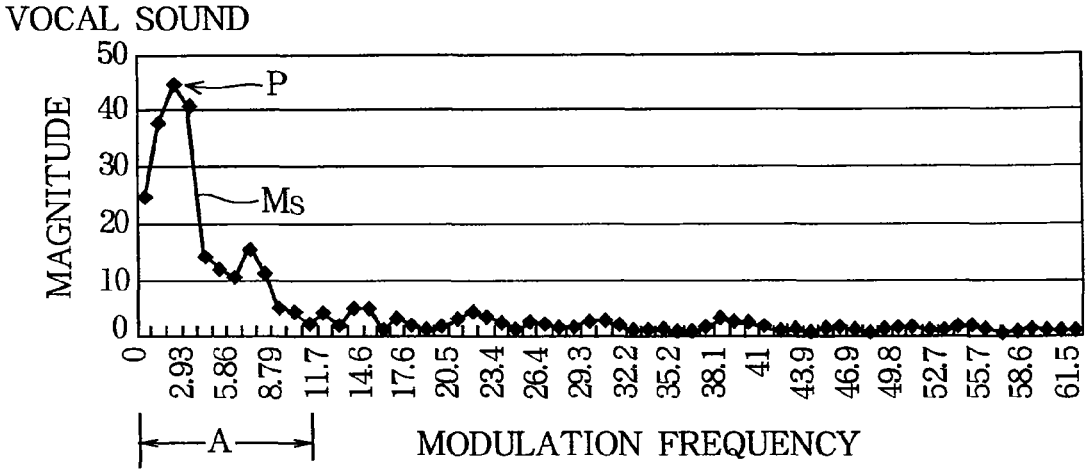
FIG. 5 illustrates a modulation spectrum of a vocal sound.
Figure 6:
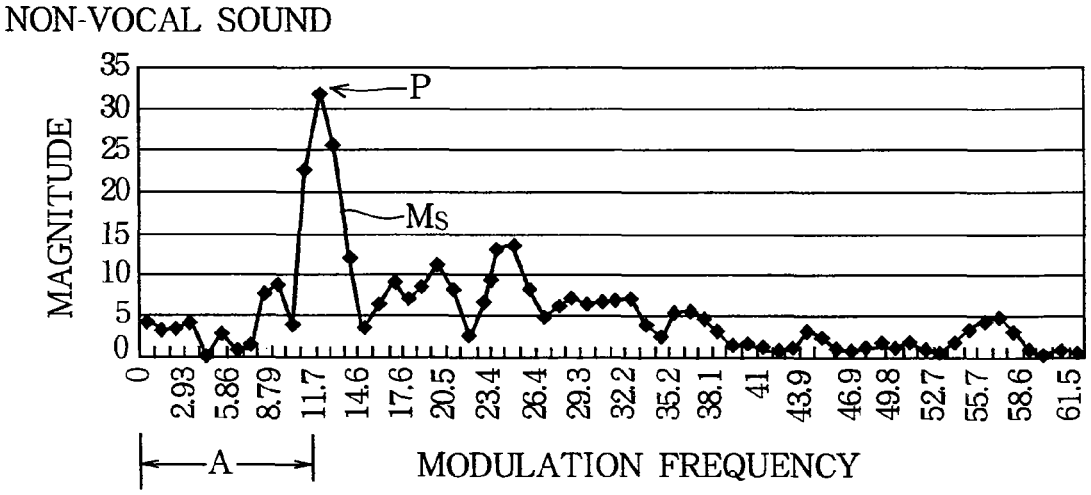
FIG. 6 illustrates a modulation spectrum of a non-vocal sound.

FIG. 5 illustrates a typical modulation spectrum of a vocal sound (i.e., a sound uttered by a human being) and FIG. 6 illustrates a modulation spectrum of a non-vocal sound (for example, a scratching sound generated by scratching a screen cover portion of a tip of the sound receiving device 12). As can be understood by comparing FIGS. 5 and 6, the range of modulation frequencies, the magnitudes of which are high, in the modulation spectrum MS of the vocal sound tends to be different from that of the non-vocal sound.

In many cases, the magnitude of the modulation spectrum MS of a normal sound uttered by a human being is maximized at a modulation frequency of about 4 Hz corresponding to the frequency at which syllables are switched during utterance. Accordingly, the modulation spectrum MS of the vocal sound shown in FIG. 5 and the modulation spectrum MS of the non-vocal sound shown in FIG. 6 differ in that the magnitude of the modulation spectrum MS shown in FIG. 5 is high in a range of low modulation frequencies equal to or less than 10 Hz whereas the magnitude of the modulation spectrum MS of most non-vocal sounds shown in FIG. 6 is high in a range of low modulation frequencies above 10 Hz. Taking into consideration of this difference, this embodiment determines whether the input sound $V_{IN}$ is a vocal sound or a non-vocal sound according to the magnitude of components of modulation frequencies belonging to a predetermined range (hereinafter referred to as "determination target range") A of the modulation spectrum MS specified by the modulation spectrum specifier 32. In this embodiment, the range of frequencies equal to or less than 10 Hz (preferably, a range of 2 Hz to 8 Hz) is set to the determination target range A.

The index calculator 34 of FIG. 2 calculates an index value D1 corresponding to the magnitude (energy) of components belonging to the determination target range A of the modulation spectrum MS that the modulation spectrum specifier 32 specifies for each unit interval $T_U$. More specifically, the index calculator 34 first calculates a magnitude L1 of components of modulation frequencies belonging to the determination target range A in the modulation spectrum MS (for example, the sum or average of magnitudes of modulation frequencies in the determination target range A) and a magnitude L2 of components of all modulation frequencies in the modulation spectrum MS (for example, the sum or average of magnitudes of all modulation frequencies of the modulation spectrum). Then, the index calculator 34 calculates an index value D1 based on the following arithmetic expression (A) including a ratio (L1/L2) between the magnitudes L1 and L2.

$$D1=1-(L1/L2) \quad \text{(A)}$$

As can be understood from the arithmetic expression (A), the index value D1 decreases as the magnitude L1 of the components in the determination target range A of the modulation spectrum MS increases (i.e., as the probability that the input sound $V_{IN}$ is a vocal sound increases). Accordingly, the index value D1 can be defined as an index indicating whether the input sound $V_{IN}$ is a vocal sound or a non-vocal sound. The index value D1 can also be defined as an index indicating whether or not a rhythm specific to a vocal sound (rhythm of utterance) is included in the input sound $V_{IN}$.

Figure 7:
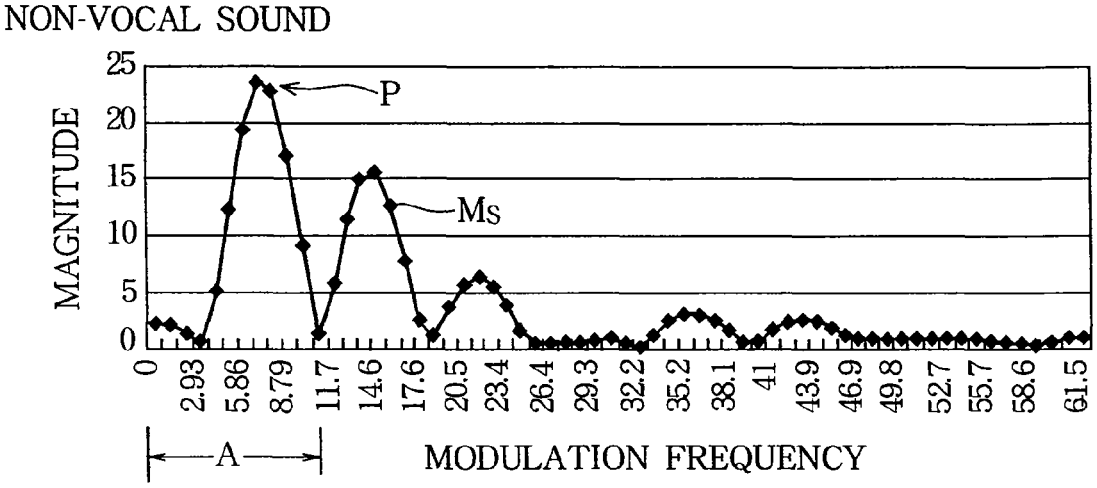
FIG. 7 illustrates a modulation spectrum of a non-vocal sound.

However, the magnitude of components of the determination target range A in the modulation spectrum MS of some non-vocal sound may be higher than that of components in other ranges. A modulation spectrum of a non-vocal sound (for example, a beep tone of a phone) shown in FIG. 7 has a peak magnitude at a modulation frequency in a range of about 5 Hz to 8 Hz included in the determination target range A. However, the maximum value P of the magnitude of the modulation spectrum MS of the non-vocal sound having characteristics shown in FIG. 7 tends to be lower than that of the vocal sound. Taking into consideration of this tendency, this embodiment determines whether the input sound $V_{IN}$ is a vocal sound or a non-vocal sound based on the index value D1 and the maximum value P of the magnitude of the modulation spectrum MS. The magnitude specifier 36 of FIG. 2 specifies the maximum value P of the magnitude of the modulation spectrum MS for each unit interval $T_U$.

Figure 8:
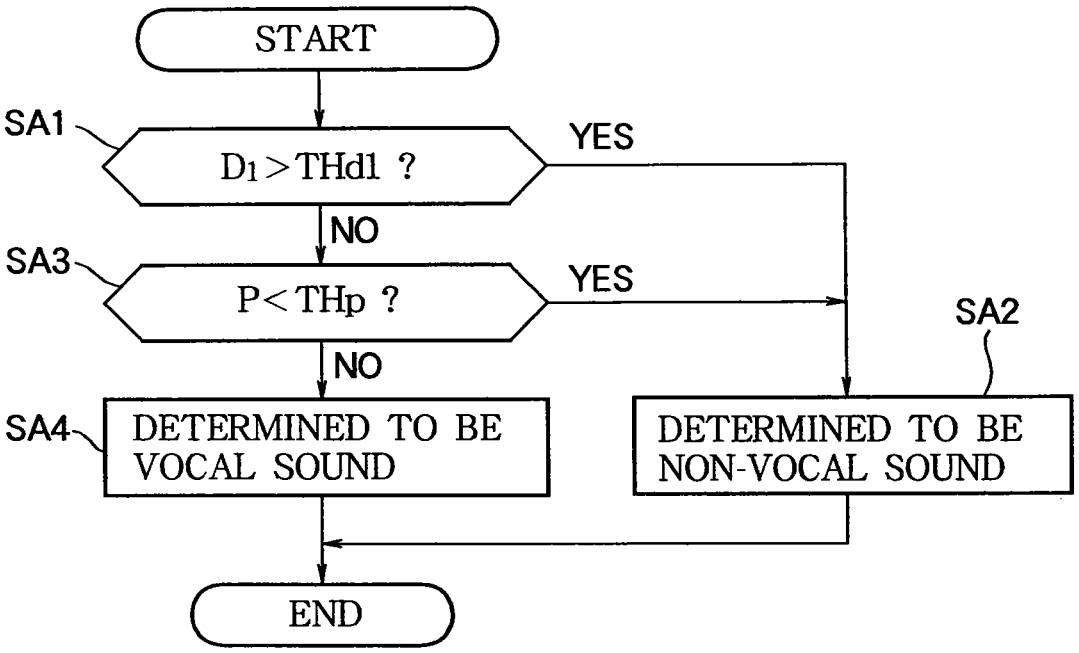
FIG. 8 is a flow chart illustrating operations of a determinator in FIG. 2.

The determinator 42 determines whether the input sound $V_{IN}$ of each unit interval $T_U$ is a vocal sound or a non-vocal sound based on the maximum value P specified by the magnitude specifier 36 and the index value D1 calculated by the index calculator 34, and generates identification data d indicating the result of the determination (as to whether the input sound $V_{IN}$ is vocal or non-vocal) for each unit interval $T_U$. FIG. 8 is a flow chart illustrating detailed operations of the determinator 42. The processes of FIG. 8 are performed each time the index value D1 and the maximum value P are specified for one unit interval $T_U$.

The determinator 42 determines whether or not the index value D1 is greater than a threshold THd1 (step SA1). The threshold THd1 is empirically or statistically selected such that the index value D1 of the vocal sound is less than the threshold THd1 while the index value D1 of the non-vocal sound is greater than the threshold THd1. When the result of step SA1 is positive (for example, when the input sound $V_{IN}$ is a non-vocal sound having the characteristics of FIG. 6), the determinator 42 determines that the input sound $V_{IN}$ of a current unit interval $T_U$ to be processed is a non-vocal sound (step SA2). That is, the determinator 42 generates identification data d indicating the non-vocal sound.

On the other hand, when the result of step SA1 is negative, the determinator 42 determines whether or not the maximum value P of the magnitude of the modulation spectrum MS is less than the threshold THp (step SA3). When the result of step SA3 is positive, the determinator 42 proceeds to step SA2 to generate identification data d indicating a non-vocal sound. That is, even though it may be determined that the input sound $V_{IN}$ is a vocal sound taking into consideration the index value D1 alone, the determinator 42 determines that the input sound $V_{IN}$ is a non-vocal sound when the maximum value P is less than the threshold THp (for example, when the input sound $V_{IN}$ is a non-vocal sound having the characteristics of FIG. 7).

When the result of step SA3 is negative (for example, when the input sound $V_{IN}$ is a vocal sound having the characteristics of FIG. 5), the determinator 42 determines that the input sound $V_{IN}$ of the current unit interval $T_U$ to be processed is a vocal sound (step SA4). That is, the determinator 42 generates identification data d indicating a vocal sound. In the manner described above, only the input sound $V_{IN}$ of each unit interval $T_U$ in which both the magnitude L1 and the maximum value P of the magnitude of the determination target range A in the modulation spectrum MS are high is determined to be a vocal sound.

The sound processor 44 of FIG. 2 performs a process corresponding to the identification data d of each unit interval $T_U$ on the audio signal $S_{IN}$ of the unit interval $T_U$ to generate an output signal $S_{OUT}$. For example, the sound processor 44 outputs the audio signal $S_{IN}$ as an output signal $S_{OUT}$ in each unit interval $T_U$ for which the identification data d indicates a vocal sound, and outputs an output signal $S_{OUT}$ with a volume set to zero (i.e., does not output the audio signal $S_{IN}$) in each unit interval $T_U$ for which the identification data d indicates a non-vocal sound. Accordingly, in each of the spaces R1 and R2, a non-vocal sound is removed from an input sound $V_{IN}$ of the other space R and the sound emitting device 18 emits only vocal sounds that the user needs to hear through the sound processing device 16.

Since this embodiment determines whether the input sound $V_{IN}$ is a vocal sound or a non-vocal sound based on the magnitude L1 of the components in the determination target range A of the modulation spectrum MS (i.e., based on presence or absence of the rhythm of utterance therein) as described above, this embodiment can more accurately identify a vocal sound and a non-vocal sound than the technology of Japanese Patent Application Publication No. 2000-132177 which uses the frequency spectrum of the input sound $V_{IN}$. In addition, since not only the magnitude L1 of the components in the determination target range A but also the maximum value P of the magnitude of the modulation spectrum MS are used for determination, it is possible to correctly determine that the input sound $V_{IN}$ is a non-vocal sound even when the magnitude L1 of the components in the determination target range A of the non-vocal sound is higher than those of other ranges.

When the volume of the non-vocal sound is high, the modulation spectrum MS has high magnitude over the entire range of modulation frequencies. Accordingly, there is a high probability that a non-vocal sound with high volume is erroneously determined to be a vocal sound in the configuration which determines whether the input sound is a vocal sound or a non-vocal sound based only on the magnitude L1 in the determination target range A of the modulation spectrum MS. This embodiment has an advantage in that it is possible to correctly determine whether the input sound is a vocal sound or a non-vocal sound even when it is a non-vocal sound with high volume since whether the input sound is a vocal sound or a non-vocal sound is determined based on both the ratio between the magnitude L1 in the determination target range A and the magnitude L2 in the entire range of modulation frequencies.

<B: Second Embodiment>

The following is a description of a second embodiment of the invention. In each of the embodiments described below, elements with operations or functions similar to those of the first embodiment are denoted by the same reference numerals and a detailed description of each of the elements will be omitted as appropriate.

Figure 9:
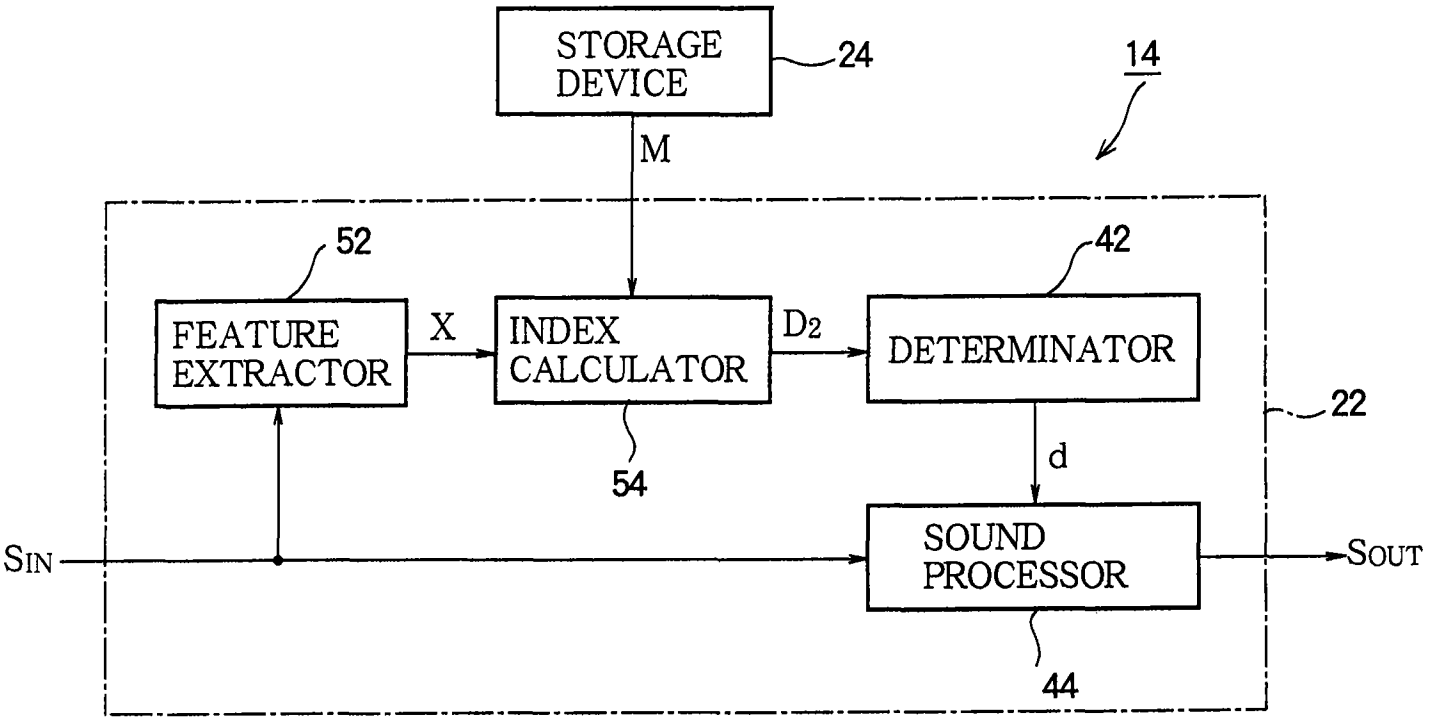
FIG. 9 is a block diagram of a sound processing device according to a second embodiment of the invention.

FIG. 9 is a block diagram of the sound processing device 14. An acoustic model M is stored in a storage device 24 of this embodiment. The acoustic model M is a statistical model obtained by modeling average acoustic characteristics of sounds of a plurality of types of vowels uttered by a number of speakers. The acoustic model M of this embodiment is obtained by modeling a distribution of feature amounts (for example, Mel-Frequency Cepstrum Coefficient (MFCC)) of vocal sounds as a weighted sum of probability distributions. For example, a Gaussian Mixture Model (GMM), which models feature amounts of a vocal sound as a weighted sum of normal distributions, is preferably used as the acoustic model M.

The acoustic model M is created as a control device 22 performs the following processes. First, the control device 22 collects vocal sounds when a number of speakers utter various sentences and classifies each vocal sound into phonemes and then extracts only waveforms of portions corresponding to the plurality of types of vowels a, i, u, e, and o. Second, the control device 22 extracts an acoustic feature amount (specifically, a feature vector) of each of a plurality of frames into which the waveform of each portion corresponding to a phoneme is divided in time. For example, the time length of each frame is 20 milliseconds and the time difference between adjacent frames is 10 milliseconds. Third, the control device 22 integrally processes feature amounts extracted from a number of vocal sounds for a plurality of types of vowels to generate an acoustic model M. For example, a known technology such as an Expectation-Maximization (EM) algorithm is optionally used to generate the acoustic model M. Since the feature amount of a vowel is affected by an immediately previous phoneme (consonant), the acoustic model M generated in the order as described above is not a statistical model which models only characteristics of a pure vowel. That is, the acoustic model M is a statistical model created mainly based on a plurality of vowels (or a statistical model of a voiced sound of a vocal sound).

As shown in FIG. 9, a sound processing device 14 includes a feature extractor 52 and an index calculator 54 instead of the modulation spectrum specifier 32, the index calculator 34, and the magnitude specifier 36 of FIG. 2. The feature extractor 52 extracts the same type of feature amount (for example, MFCC) as the feature amount used to generate the acoustic model M in each frame of the audio signal $S_{IN}$. A known technology is optionally used when the feature extractor 52 extracts the feature amount X.

The index calculator 54 calculates an index value D2 corresponding to whether or not the input sound $V_{IN}$ indicated by the audio signal $S_{IN}$ is similar to the acoustic model M for each unit interval $T_U$ of the audio signal $S_{IN}$. More specifically, the index value D2 is a numerical value obtained by averaging the likelihood (probability) p (X|M) that is obtained from the feature amount X extracted from the audio signal $S_{IN}$ of each frame and from the acoustic model M for a total of n frames in the unit interval $T_U$. That is, the index calculator 54 calculates the index value D2 using the following arithmetic expression (B).

$$D_2 = \frac{1}{n}\sum_{i=1}^{n}(-\log p(X_{[i]} \mid M)) \tag{B}$$

As can be understood from the arithmetic expression (B), the index value D2 decreases as the degree of similarity between the input sound $V_{IN}$ of the unit interval $T_U$ and the acoustic model M increases. Vocal sounds tend to have a large proportion of vowels, when compared to non-vocal sounds. Thus, the degree of similarity of vocal sounds to the acoustic model M is high. Accordingly, the index value D2 calculated when the input sound $V_{IN}$ is a vocal sound is smaller than that calculated when the input sound $V_{IN}$ is a non-vocal sound. That is, the index value D2 can be defined as an index indicating whether the input sound $V_{IN}$ is a vocal sound or a non-vocal sound. Thus, the acoustic model M can also be defined as a statistical model of a vocal sound (i.e., a sound uttered by a human being).

The determinator 42 of FIG. 9 determines whether an input sound $V_{IN}$ of each unit interval $T_U$ is a vocal sound or a non-vocal sound based on the index value D2 calculated by the index calculator 54, and generates identification data d indicating the result of the determination for each unit interval $T_U$. Thus, the index value D2 is a numerical value indicating the similarity of tone color between the input sound $V_{IN}$ and the acoustic model M. That is, while whether or not the rhythm of the input sound $V_{IN}$ (i.e., the magnitude L1 in the determination target range A) is similar to that of a vocal sound is determined in the first embodiment, whether or not the tone color of the input sound $V_{IN}$ is similar to that of a vocal sound is determined in this embodiment.

More specifically, the determinator 42 determines whether or not the index value D2 of each unit interval $T_U$ is greater than a predetermined threshold THd2. The threshold THd2 is empirically or statistically selected such that the index value D2 of the vocal sound is less than the threshold THd2 while the index value D2 of the non-vocal sound is greater than the threshold THd2. When the result of the determination is positive (i.e., D2>THd2), the determinator 42 determines that the input sound $V_{IN}$ of the corresponding unit interval $T_U$ is a non-vocal sound and generates identification data d. On the other hand, when the result of the determination is negative (i.e., D2<THd2), the determinator 42 determines that the input sound $V_{IN}$ of the corresponding unit interval $T_U$ is a vocal sound and generates identification data d. Operations of the sound processor 44 according to the identification data d are similar to those of the first embodiment.

Since this embodiment determines whether the input sound $V_{IN}$ is a vocal sound or a non-vocal sound according to whether or not the input sound is similar to the acoustic model M obtained by modeling vocal sounds of vowels, this embodiment can more accurately identify a vocal sound and a non-vocal sound than the technology of Japanese Patent Application Publication No. 2000-132177 which uses the frequency spectrum of the input sound $V_{IN}$. In addition, since one acoustic model M which integrally models a plurality of types of vowels is stored in the storage device 24, the required capacity of the storage device 24 is reduced compared to the configuration in which individual acoustic models are prepared for the plurality of types of vowels.

<C: Third Embodiment>

Figure 10:
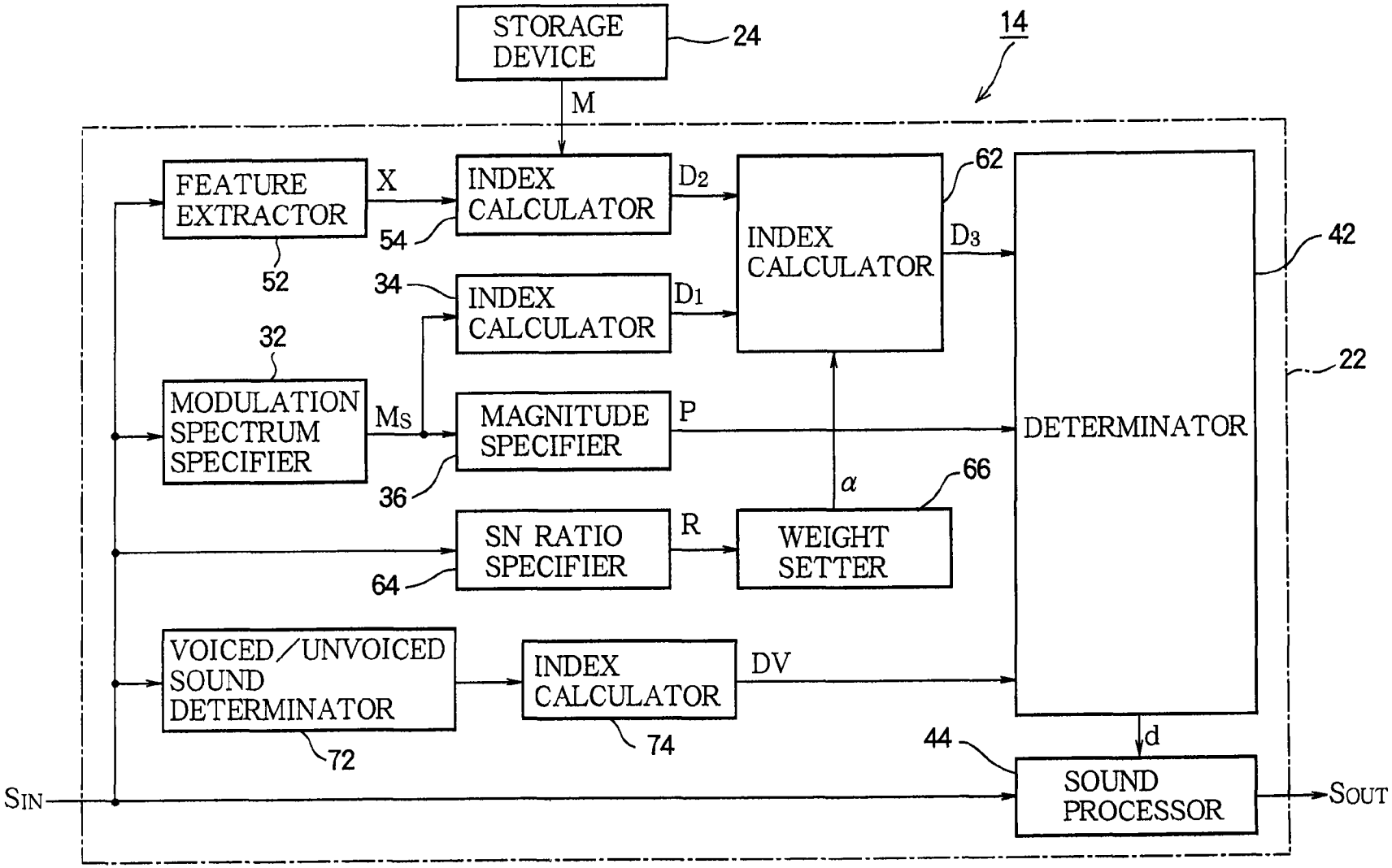
FIG. 10 is a block diagram of a sound processing device according to a third embodiment of the invention.

FIG. 10 is a block diagram of a sound processing device 14 according to a third embodiment of the invention. Similar to the first embodiment, a modulation spectrum specifier 32 and an index calculator 34 of FIG. 10 calculate an index value of each unit interval $T_U$ of an input sound $V_{IN}$ and a magnitude specifier 36 specifies a maximum value P of the magnitude of the modulation spectrum MS. In addition, a feature extractor 52 and an index calculator 54 calculate an index value D2 of each unit interval $T_U$ of the input sound $V_{IN}$, similar to the second embodiment.

An index calculator 62 calculates, as an index value D3, a weighted sum of the index value D1 calculated by the index calculator 34 and the index value D2 calculated by the index calculator 54. The index value D3 is calculated, for example using the following arithmetic expression (C).

$$D3=D1+\alpha\cdot D2 \quad (C)$$

As can be understood from the arithmetic expression (C), the index value D3 decreases as the probability that the input sound $V_{IN}$ is a vocal sound increases (i.e., as the magnitude L1 in the determination target range A of the modulation spectrum MS increases or as the similarity of feature amounts of the acoustic model M and the input sound $V_{IN}$ in the unit interval $T_U$ increases) increases. The weight $\alpha$ is a positive number ($\alpha>0$) set by a weight setter 66 of FIG. 10. The index value D3 calculated by the index calculator 62 is used when the determinator 42 determines whether the input sound $V_{IN}$ is a vocal sound or a non-vocal sound.

The SN ratio specifier 64 of FIG. 10 calculates an SN ratio R of the audio signal $S_{IN}$ (input sound $V_{IN}$) for each unit interval $T_U$. The weight setter 66 variably sets the weight $\alpha$, which the index calculator 62 uses to calculate the index value D3 of each unit interval $T_U$, based on the SN ratio R that the SN ratio specifier 64 calculates for the corresponding unit interval $T_U$.

Here, the index value D1 calculated from the modulation spectrum MS tends to be easily affected by noise of the input sound $V_{IN}$, when compared to the index value D2 calculated from the acoustic model M. Thus, the weight setter 66 variably controls the weight $\alpha$ such that the weight $\alpha$ increases as the SN ratio R decreases (i.e., as the level of noise increases). Since the influence of the index value D2 in the index value D3 relatively increases (i.e., the influence of the index value D1 which is easily affected by noise decreases) as the SN ratio R decreases in the configuration described above, it is possible to accurately determine whether the input sound $V_{IN}$ is a vocal sound or a non-vocal sound even when noise is superimposed in the input sound $V_{IN}$.

The voiced/unvoiced sound determinator 72 of FIG. 10 determines whether the input sound $V_{IN}$ of each of a plurality of frames is a voiced sound or an unvoiced sound. A known technology is optionally used for the determination of the voiced/unvoiced sound determinator. For example, the voiced/unvoiced sound determinator 72 detects a pitch (fundamental frequency) in each frame of the input sound $V_{IN}$ and determines that each frame in which an effective pitch has been detected is that of a voiced sound and determines that each frame in which no distinct pitch has been detected is that of an unvoiced sound.

The index calculator 74 calculates a voiced sound index value DV of each unit interval $T_U$ of the audio signal $S_{IN}$. The voiced sound index value DV is the ratio of the number of frames NV, each of which the voiced/unvoiced sound determinator 72 have determined to be a voiced sound, to the total of n frames in the unit interval $T_U$ (i.e., DV=NV/n). A vocal sound (i.e., a sound uttered by a human being) tends to have a high proportion of the voiced sound, compared to the non-vocal sound. Accordingly, the voiced sound index value DV calculated when the input sound $V_{IN}$ is a vocal sound is higher than that calculated when the input sound $V_{IN}$ is a non-vocal sound.

Figure 11:
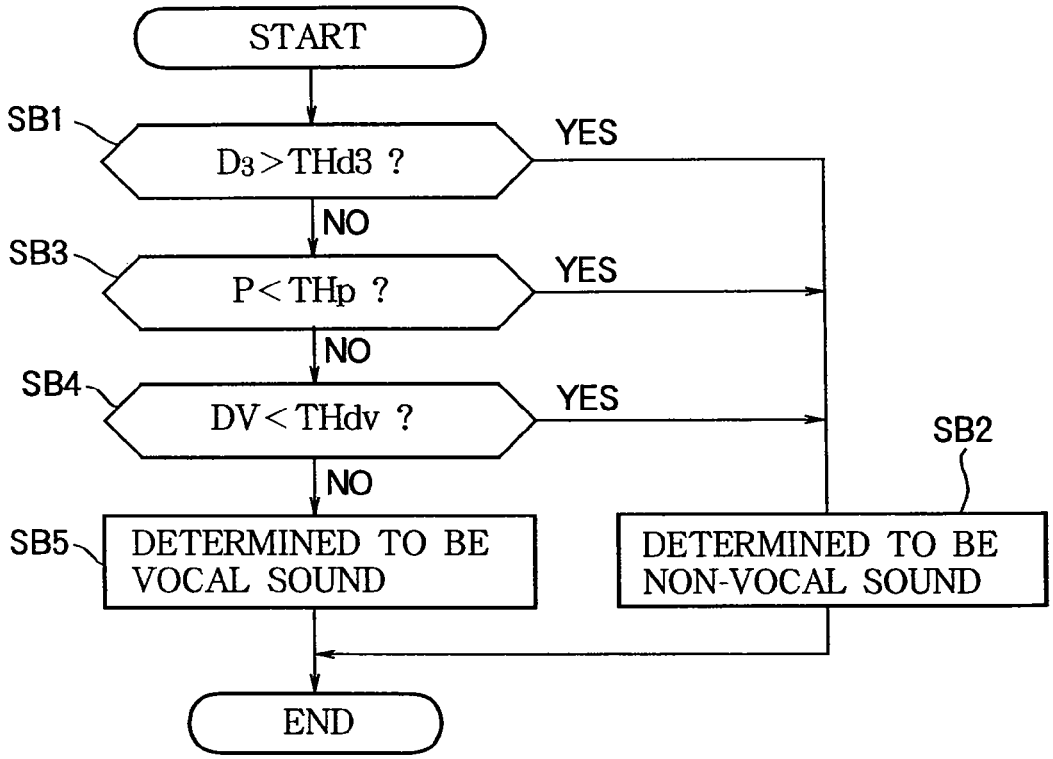
FIG. 11 is a flow chart illustrating operations of a determinator in FIG. 10.

The determinator 42 of FIG. 10 determines whether the input sound $V_{IN}$ of each unit interval $T_U$ is a vocal sound or non-vocal sound based on the index value D3 calculated by the index calculator 62, the maximum value P specified by the magnitude specifier 36, and the voiced sound index value DV calculated by the index calculator 74, and generates identification data d indicating the result of the determination for each unit interval $T_U$. FIG. 11 is a flow chart illustrating detailed operations of the determinator 42. The processes of FIG. 11 are performed each time the index value D3, the maximum value P, and the voiced sound index value DV are specified for one unit interval $T_U$.

The determinator 42 determines whether or not the index value D3 is greater than a threshold value THd3 (step SB1). The threshold value THd3 is empirically or statistically selected such that the index value D3 of the vocal sound is less than the threshold value THd3 while the index value D3 of the non-vocal sound is greater than the threshold value THd3. When the result of step SB1 is positive, the determinator 42 determines that the input sound $V_{IN}$ of a current unit interval $T_U$ is a non-vocal sound and generates identification data d (step SB2).

On the other hand, when the result of step SB1 is negative, the determinator 42 determines whether or not the maximum value P is less than the threshold THp, similar to the above step SA3 of FIG. 8 (step SB3). When the result of step SB3 is positive, the determinator 42 generates identification data d indicating a non-vocal sound at step SB2. When the result of step SB3 is negative, the determinator 42 determines whether or not the voiced sound index value DV is less than a threshold THdv (step SB4).

When the result of step SB4 is positive (i.e., when the proportion of frames of voiced sounds in the unit interval $T_U$ is low), the determinator 42 generates identification data d indicating a non-vocal sound at step SB2. On the other hand, when the result of step SB4 is negative, the determinator 42 determines that the input sound $V_{IN}$ of the current unit interval $T_U$ is a vocal sound and generates identification data d. Operations of the sound processor 44 according to the identification data d are similar to those of the first embodiment.

Since this embodiment determines whether the input sound $V_{IN}$ is a vocal sound or a non-vocal sound based on both the rhythm (index value D1) and the tone color (index value D2) of the input sound $V_{IN}$ as described above, this embodiment can more accurately determine whether the input sound $V_{IN}$ is a vocal sound or a non-vocal sound than the first or second embodiment. In addition, for example even when the rhythm or tone color of the input sound $V_{IN}$ is similar to that of a vocal sound, it is possible to correctly determine that the input sound $V_{IN}$ is a non-vocal sound if the voiced sound index value DV is low since not only the index value D1 and the index value D2 but also the voiced sound index value DV are used for the determination.

D: EXAMPLE MODIFICATIONS

A variety of modifications may be applied to the above embodiments. The following are detailed examples of the modifications. Two or more of the following examples may be selected and combined.

(1) Example Modification 1

Figure 12:
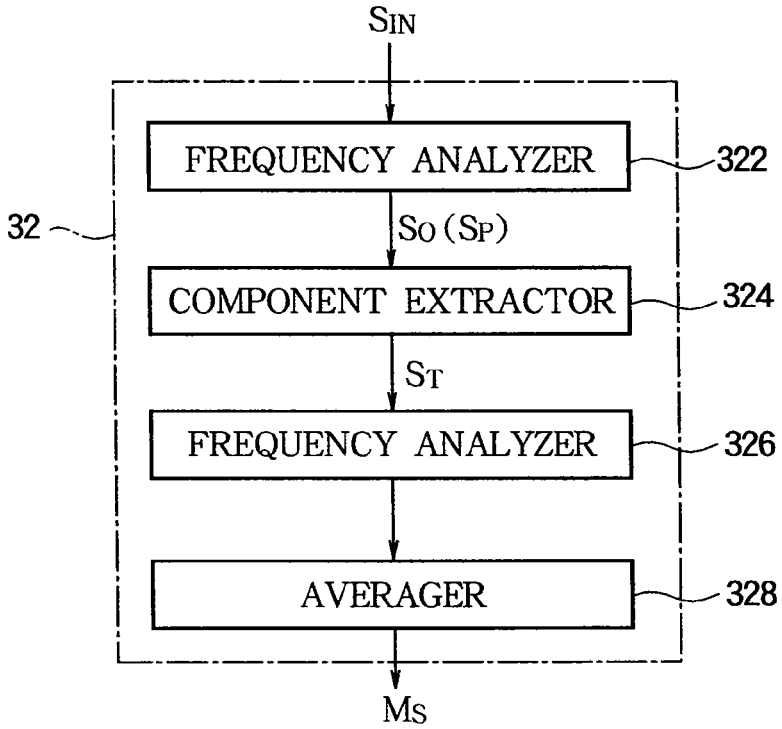
FIG. 12 is a block diagram of a modulation spectrum specifier according to an example modification.

The configuration of the modulation spectrum specifier 32 is modified to that shown in FIG. 12. The modulation spectrum specifier 32 of FIG. 12 includes an averager 328 in addition to the frequency analyzer 322, the component extractor 324, and the frequency analyzer 326 which are the same components as those of FIG. 3. Here, each of the plurality of unit intervals $T_U$, into which the temporal trajectory $S_T$ generated by the component extractor 324 is divided, is further divided into m intervals (hereinafter referred to as "divided intervals") where "m" is a natural number greater than 1. The frequency analyzer 326 performs a Fourier transform on the temporal trajectory $S_T$ in each divided interval to calculate a modulation spectrum of each divided interval. The averager 328 averages m modulation spectra calculated for the m divided intervals included in each unit interval $T_U$ to calculate the modulation spectrum MS of the unit interval $T_U$. Since the number of points of the Fourier transform performed by the frequency analyzer 326 is reduced compared to the first embodiment, the configuration of FIG. 12 has an advantage in that load caused by (specifically, the amount of calculation for) Fourier transform of the frequency analyzer 326 or the capacity of the storage device 24 required for the Fourier transform is reduced.

(2) Example Modification 2

Figure 13:
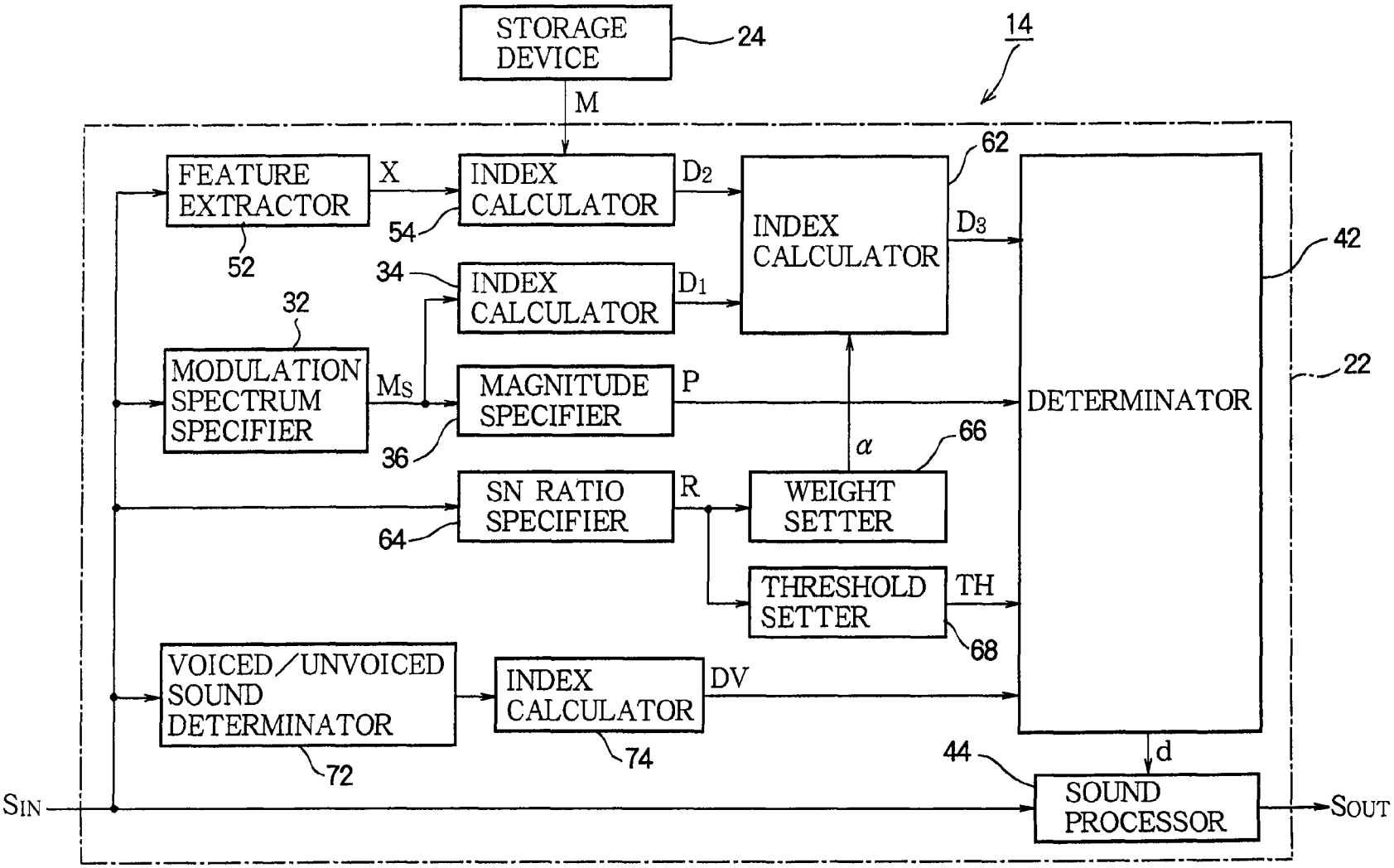
FIG. 13 is a block diagram of a sound processing device according to an example modification.

It is also preferable to employ a configuration in which the thresholds TH (THd1, THd2, THd3, THp, and THdv) used to determine whether the input sound $V_{IN}$ is a vocal sound or a non-vocal sound are variably controlled. For example, as shown in FIG. 13, a threshold setter 68 is added to the sound processing device 14 of the third embodiment. The threshold setter 68 variably controls the threshold TH according to the SN ratio R calculated by the SN ratio specifier 64.

If the SN ratio R is low even though the input sound $V_{IN}$ is actually a vocal sound, the determinator 42 is likely to erroneously determine that the input sound $V_{IN}$ is a non-vocal sound. Therefore, the threshold setter 68 controls each threshold TH such that the input sound $V_{IN}$ is more easily determined to be a vocal sound as the SN ratio R calculated by the SN ratio specifier 64 decreases. For example, the threshold value THd3 is increased and the threshold THp or the threshold THdv is reduced as the SN ratio R decreases. This configuration can reduce the possibility that the input sound $V_{IN}$ is erroneously determined to be a non-vocal sound even though the input sound $V_{IN}$ actually includes a vocal sound. A configuration in which the threshold TH is variably controlled according to a numerical value (for example, the volume of the input sound $V_{IN}$) other than the SN ratio R may also be employed. Although a modification of the third embodiment is illustrated in FIG. 13, a configuration in which the SN ratio specifier 64 and the threshold setter 68 are added may also be employed in the sound processing device 14 of the first or second embodiment.

(3) Example Modification 3

In each of the above embodiments, there is a possibility that a unit interval $T_U$ is determined to be a non-vocal sound when the proportion of a vocal sound included in the unit interval $T_U$ is low (for example, when a vocal sound is included only in a short interval within the unit interval $T_U$). Accordingly, in the configuration in which the input sound $V_{IN}$ is collectively muted for all unit intervals $T_U$ that have all been determined to be a non-vocal sound, a unit interval $T_U$ which includes a small part of the start or end portion of a vocal sound (particularly, an unvoiced consonant portion) may be determined to be a non-vocal sound and may then be muted. Therefore, it is preferable to employ a configuration in which the input sound $V_{IN}$ of each of a plurality of unit intervals $T_U$ is muted taking into consideration of determinations that the determinator 42 makes for the plurality of unit intervals $T_U$.

Figure 14:
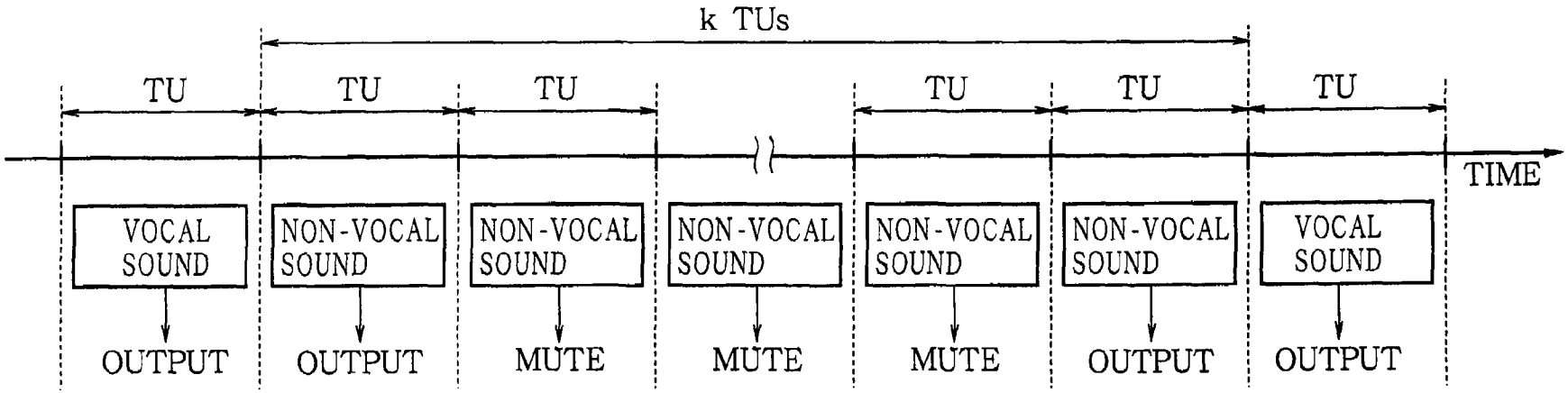
FIG. 14 is a conceptual diagram illustrating operations of a sound processor according to an example modification.

For example, the sound processor 44 does not mute a unit interval $T_U$ when the unit interval $T_U$ has been determined to be a non-vocal sound but instead mutes input sounds $V_{IN}$ of unit intervals $T_U$ excluding the first and last (1st and kth) unit intervals $T_U$ among a set of k consecutive unit intervals $T_U$ (where "k" is a natural number greater than 2) (i.e., mutes the input sounds $V_{IN}$ of unit intervals $T_U$ in the middle of the set of k unit intervals $T_U$) when the input sounds $V_{IN}$ of the k consecutive unit intervals $T_U$ have been determined to be a non-vocal sound as shown in FIG. 14. That is, the sound processor 44 does not mute the input sounds $V_{IN}$ of the first and kth unit intervals $T_U$. For example, the sound processor 44 mutes only an input sound $V_{IN}$ of a second unit interval $T_U$ among 3 (k=3) unit intervals $T_U$ that have been determined to be a non-vocal sound. This configuration has an advantage in that it prevents loss of a vocal sound since a unit interval $T_U$ which includes a vocal sound only at a portion immediately after the start of the unit interval $T_U$ (for example, the 1st of the k unit intervals $T_U$ of FIG. 14) or a unit interval $T_U$ which includes a vocal sound only at a portion immediately before the end of the unit interval $T_U$ (for example, the kth unit interval $T_U$ of FIG. 14) is not muted.

(4) Example Modification 4

The definitions of the index values D (D1, D2, and D3) are changed appropriately. Thus, the relation between each of the index values D (D1, D2, and D3) and the determination as to whether the input sound $V_{IN}$ is a vocal sound or a non-vocal sound is optional. For example, although the index value D1 has been defined such that the possibility that the input sound $V_{IN}$ is determined to be a vocal sound increases as the index value D1 decreases in the first embodiment, for example, the ratio of the magnitude L1 to the magnitude L2 may be defined as the index value D1 (i.e., D1=L1/L2) such that the possibility that the input sound $V_{IN}$ is determined to be a vocal sound increases as the index value D1 increases. In addition, although the index value D3 has been defined using one weight $\alpha$, it is also preferable to employ a configuration in which the index value D3 is calculated using weights ($\beta$, Y) that have been set separately from the index value D1 and the index value D2 (i.e., $D3=\beta \cdot D1+Y \cdot D2$). The weights ($\alpha$, $\beta$, Y) applied to calculate the index value D3 may also be fixed.

(5) Example Modification 5

Although the modulation spectrum MS has been specified by performing a Fourier transform on the temporal trajectory $S_T$ of the components belonging to the frequency band $\omega$ in the logarithmic spectrum $S_0$ in the first and third embodiments, a configuration in which the modulation spectrum MS is specified by performing a Fourier transform on a temporal trajectory of a cepstrum of the audio signal $S_{IN}$ (input sound $V_{IN}$) may also be employed. More specifically, the frequency analyzer 322 of the modulation spectrum specifier 32 calculates a cepstrum on each frame of the audio signal $S_{IN}$, the component extractor 324 extracts a temporal trajectory $S_T$ of components whose frequency is within a specific range in the cepstrum of each frame, and the frequency analyzer 326 performs a Fourier transform on the temporal trajectory $S_T$ of the cepstrum for each unit interval $T_U$ (or for each divided interval in the example modification 1) to calculate the modulation spectrum MS of the unit interval $T_U$.

(6) Example Modification 6

The variables used to determine whether the input sound $V_{IN}$ is a vocal sound or a non-vocal sound are changed appropriately. For example, the determination according to the maximum value P (at step SA3 of FIG. 8 or at step SB3 of FIG. 11) may be omitted in the first or third embodiment and the determination according to the voiced sound index value DV (at step SB4 of FIG. 11) may be omitted in the third embodiment. It is also preferable to employ a configuration in which the voiced/unvoiced sound determinator 72 and the index calculator 74 are added in the first or second embodiment.

(7) Example Modification 7

Although the identification data d and the output signal $S_{OUT}$ are generated at the sound processing device 14 in the space R that has received the input sound $V_{IN}$ in each of the above embodiments, the location where the identification data d is generated or the location where the output signal $S_{OUT}$ is generated is changed appropriately. For example, in a configuration in which the audio signal $S_{IN}$ generated by the sound receiving device 12 and the identification data d generated by the determinator 42 are output from the sound processing device 14, the sound processor 44 which generates the output signal $S_{OUT}$ from the audio signal $S_{IN}$ and the identification data d is provided in the sound processing device 16 of the receiving side. In addition, in a configuration in which the audio signal $S_{IN}$ generated by the sound receiving device 12 is transmitted by the sound processing device 14, the same components as those of FIG. 2 are provided in the sound processing device 16 of the receiving side. The remote conference system 100 is only an example application of the invention. Accordingly, reception and transmission of the output signal $S_{OUT}$ or the audio signal $S_{IN}$ is not essential in the invention.

(8) Example Modification 8

Although each of the above embodiments is exemplified by a configuration in which the sound processor 44 does not output the audio signal $S_{IN}$ of each unit interval $T_U$ that has been determined to be a non-vocal sound (i.e., sets the volume of the output signal $S_{OUT}$ to zero), the processes performed by the sound processor 44 are changed appropriately. For example, it is preferable to employ a configuration in which the sound processor 44 outputs, as an output signal $S_{OUT}$, a signal obtained by reducing the volume of the audio signal $S_{IN}$ for each unit interval $T_U$ that has been determined to be a non-vocal sound or a configuration in which the sound processor 44 outputs, as an output signal $S_{OUT}$, a signal obtained by imparting individual acoustic effects to an audio signal $S_{IN}$ for each unit interval $T_U$ that has been determined to be a vocal sound and each unit interval $T_U$ that has been determined to be a non-vocal sound. In addition, in a configuration in which voice recognition or speaker recognition (speaker identification or speaker authentication) is performed at the destination of the output signal $S_{OUT}$ (i.e., at the sound processing device 16), for example, the sound processor 44 extracts a feature amount used for voice recognition or speaker recognition and outputs the extracted feature amount as an output signal $S_{OUT}$ for each unit interval $T_U$ that has been determined to be a vocal sound, and stops extraction of the feature amount for each unit interval $T_U$ that has been determined to be a non-vocal sound.

The invention claimed is:

1. A sound processing device comprising a control device coupled to a storage device, the control device comprising an arithmetic processing unit that, by executing a program, functions as:

a modulation spectrum specifier that specifies a modulation spectrum of an input sound for each of a plurality of unit intervals which are arranged along a time axis;

a first index calculator that calculates a first index value corresponding to a magnitude of components of modulation frequencies belonging to a predetermined range of the modulation spectrum; and a determinator that determines whether the input sound of each of the unit intervals is a vocal sound or a non-vocal sound based on the first index value, wherein the first index calculator calculates the first index value based on a ratio between the magnitude of the components of the modulation frequencies belonging to the predetermined range of the modulation spectrum and a magnitude of components of modulation frequencies belonging to a range including the predetermined range and being wider than the predetermined range.

2. The sound processing device according to claim 1, wherein the first index calculator calculates the first index value based on a ratio between the magnitude of the components of the modulation frequencies belonging to the predetermined range of the modulation spectrum and a magnitude of components of modulation frequencies belonging to a range including the predetermined range.

3. The sound processing device according to claim 1, wherein the arithmetic processing unit further functions as:

a magnitude specifier that specifies a maximum value of a magnitude of the modulation spectrum, wherein the determinator determines whether the input sound is a vocal sound or a non-vocal sound based on the first index value and the maximum value of the magnitude of the modulation spectrum.

4. The sound processing device according to claim 1, wherein the modulation spectrum specifier includes:

a component extractor that specifies a temporal trajectory of a specific component in a cepstrum or a logarithmic spectrum of the input sound;

a frequency analyzer that performs a Fourier transform on the temporal trajectory for each of a plurality of intervals into which the unit interval is divided; and an averager that averages results of the Fourier transform of the plurality of the divided intervals to specify the modulation spectrum of the unit interval.

5. The sound processing device according to claim 1, wherein the arithmetic processing unit further functions as:

a threshold setter that variably sets a threshold according to an SN ratio of the input sound, wherein the determinator determines whether the input sound is a vocal sound or a non-vocal sound according to whether the first index value is greater or smaller than the threshold.

6. The sound processing device according to claim 1, wherein the modulation spectrum specifier includes:

a first frequency analyzer that analyzes the input sound to obtain a cepstrum or a logarithmic spectrum of the input sound for each of a sequence of frames defined within the unit interval;

a component extractor that specifies a temporal trajectory of a specific component in the cepstrum or the logarithmic spectrum along the sequence of the frames for the unit interval; and a second frequency analyzer that performs a Fourier transform on the temporal trajectory of the unit interval to thereby specify the modulation spectrum of the unit interval as the result of the Fourier transform of the temporal trajectory.

7. A non-transitory machine readable medium containing a program executable by a computer to perform:

a modulation spectrum specification process to specify a modulation spectrum of an input sound for each of a plurality of unit intervals which are arranged along a time axis;

a first index calculation process to calculate a first index value corresponding to a magnitude of components of modulation frequencies belonging to a predetermined range of the modulation spectrum; and a determination process to determine whether the input sound of each of the unit intervals is a vocal sound or a non-vocal sound based on the first index value, wherein the first index calculation process calculates the first index value based on a ratio between the magnitude of the components of the modulation frequencies belonging to the predetermined range of the modulation spectrum and a magnitude of components of modulation frequencies belonging to a range including the predetermined range and being wider than the predetermined range.

8. A sound processing device comprising a control device coupled to a storage device, the control device comprising an arithmetic processing unit that, by executing a program, functions as:

a modulation spectrum specifier that specifies a modulation spectrum of an input sound for each of a plurality of unit intervals;

a first index calculator that calculates a first index value corresponding to a magnitude of components of modulation frequencies belonging to a predetermined range of the modulation spectrum;

a storage that stores an acoustic model generated from a vocal sound of a vowel;

a second index value calculator that calculates a second index value for each unit interval, the second index value indicating whether or not the input sound is similar to the acoustic model; and a determinator that determines whether the input sound of each unit interval is a vocal sound or a non-vocal sound based on the first index value and the second index value of each unit interval.

9. The sound processing device according to claim 8, wherein the storage stores one acoustic model generated from a vocal sound containing a plurality of types of vowels.

10. The sound processing device according to claim 8, wherein the arithmetic processing unit further functions as:

a third index value calculator that calculates a weighted sum of the first index value and the second index value as a third index value, wherein the determinator determines whether the input sound of each unit interval is a vocal sound or a non-vocal sound based on the third index value of the unit interval.

11. The sound processing device according to claim 10, wherein the third index value calculator includes a weight sum setter that variably sets a weight according to an SN ratio of the input sound such, and the third index value calculator uses the weight for calculating the weighted sum of the first index value and the second index value.

12. The sound processing device according to claim 8, wherein the arithmetic processing unit further functions as:

a voiced sound index calculator that calculates a voiced sound index value according to a proportion of voiced sound intervals among a plurality of intervals into which the unit interval is divided, wherein the determinator determines whether the input sound is a vocal sound or a non-vocal sound based on the voiced sound index value.

13. The sound processing device according to claim 8, wherein the arithmetic processing unit further functions as:

a sound processor that mutes only the input sound of unit intervals in the middle of a set of three or more consecutive unit intervals when the determinator has determined that the three or more consecutive unit intervals are all a non-vocal sound.

14. A non-transitory machine readable medium containing a program executable by a computer to perform:

a modulation spectrum specification process to specify a modulation spectrum of an input sound for each of a plurality of unit intervals;

a first index calculation process to calculate a first index value corresponding to a magnitude of components of modulation frequencies belonging to a predetermined range of the modulation spectrum;

a second index value calculator that calculates a second index value for each unit interval, the second index value indicating whether or not the input sound is similar to an acoustic model which is generated from a vocal sound of a vowel; and a determination process to determine whether the input sound of each of the unit intervals is a vocal sound or a non-vocal sound based on the first index value and the second index value.

* * * * *